US007055705B2

(12) United States Patent
Sprave

(10) Patent No.: US 7,055,705 B2
(45) Date of Patent: Jun. 6, 2006

(54) CENTRAL BUFFER COUPLING

(75) Inventor: Rainer Sprave, Goslar (DE)

(73) Assignee: Voith Turbo Scharfenberg GmbH & Co. KG, Salzgitter (DE)

( * ) Notice: Subject to any disclaimer, the term of this patent is extended or adjusted under 35 U.S.C. 154(b) by 0 days.

(21) Appl. No.: 11/002,494

(22) Filed: Dec. 2, 2004

(65) Prior Publication Data

US 2005/0121404 A1 Jun. 9, 2005

(30) Foreign Application Priority Data

Dec. 5, 2003 (EP) ..... 03028145

(51) Int. Cl.
*B61G 7/00* (2006.01)

(52) U.S. Cl. ..... 213/20; 213/18; 213/21; 213/12; 213/74

(58) Field of Classification Search ..... 213/18, 213/19, 20, 21, 12, 4, 74
See application file for complete search history.

(56) References Cited

U.S. PATENT DOCUMENTS

| | | | | |
|---|---|---|---|---|
| 3,484,000 | A | 12/1969 | Cope | |
| 3,627,144 | A | 12/1971 | Dwyer, Jr. | |
| 3,926,317 | A | 12/1975 | Scharfenberg et al. | |
| 4,013,175 | A * | 3/1977 | Klein et al. | 213/20 |
| 4,289,247 | A * | 9/1981 | Brand et al. | 213/20 |
| 5,472,104 | A * | 12/1995 | Domsgen | 213/4 |
| 6,805,251 | B1 * | 10/2004 | Radewagen et al. | 213/20 |

FOREIGN PATENT DOCUMENTS

| | | |
|---|---|---|
| DE | 28 22 104 | 11/1979 |
| DE | 101 62 731 | 7/2003 |

OTHER PUBLICATIONS

Extended European Search Report in EP 03 028 145.5 with English Translation, no date.

* cited by examiner

*Primary Examiner*—Mark T. Le
(74) *Attorney, Agent, or Firm*—Collard & Roe, P.C.

(57) ABSTRACT

A central buffer coupling for coupling a first rail car body with a second, adjacent rail car body of a multiple-unit rail vehicle, has a coupling head pivotally connected by a coupling shaft to a linking housing of the rail car body, and a pivoting unit pivoting the coupling shaft. The pivoting unit has a guide participating in horizontal pivoting of the shaft that runs about a vertical pivot axis. Pressure surfaces symmetrical to the longitudinal axis of the shaft which correspond to a respective pressure device, bring about horizontal re-centering of the shaft. The respective pressure devices are supported on the linking housing of the shaft to bias the related pressure surfaces against the guide. The guide is positionable with the action-linked coupling shaft in every position of the planned pivot region, via an activation device. In order to have the pivoting unit not be in engagement during traveling operation and thereby be unaffected by pivoting-out movements of the coupling shaft, the activation device pushes a guide pin guided by way of a contour into a guide driver. Because the driver is then connected with the bearing pin, the coupling shaft pivots.

11 Claims, 6 Drawing Sheets

(Perspective View)

(Side View)

(Top View)

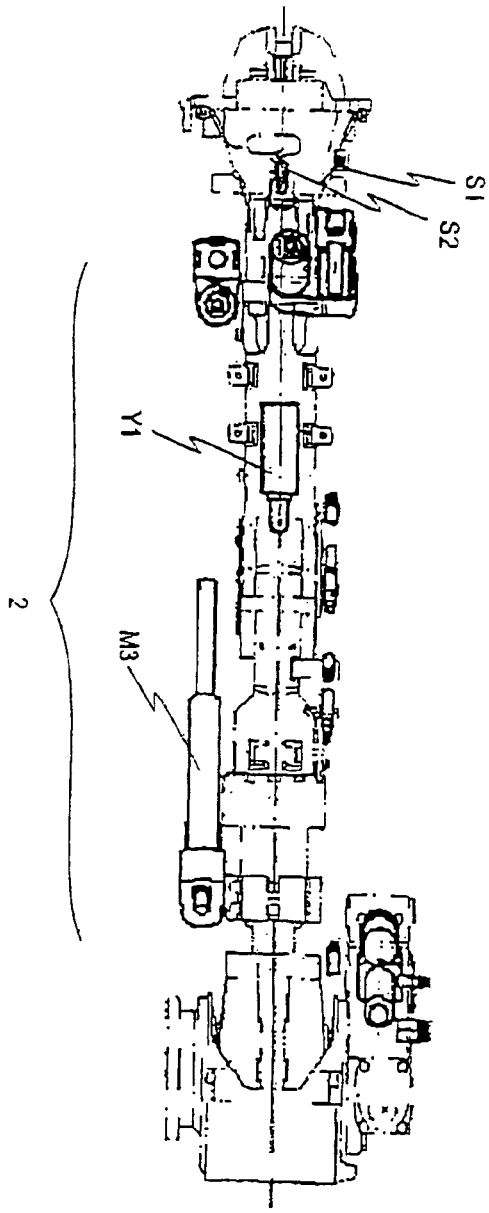
FIG. 6A (Side View)
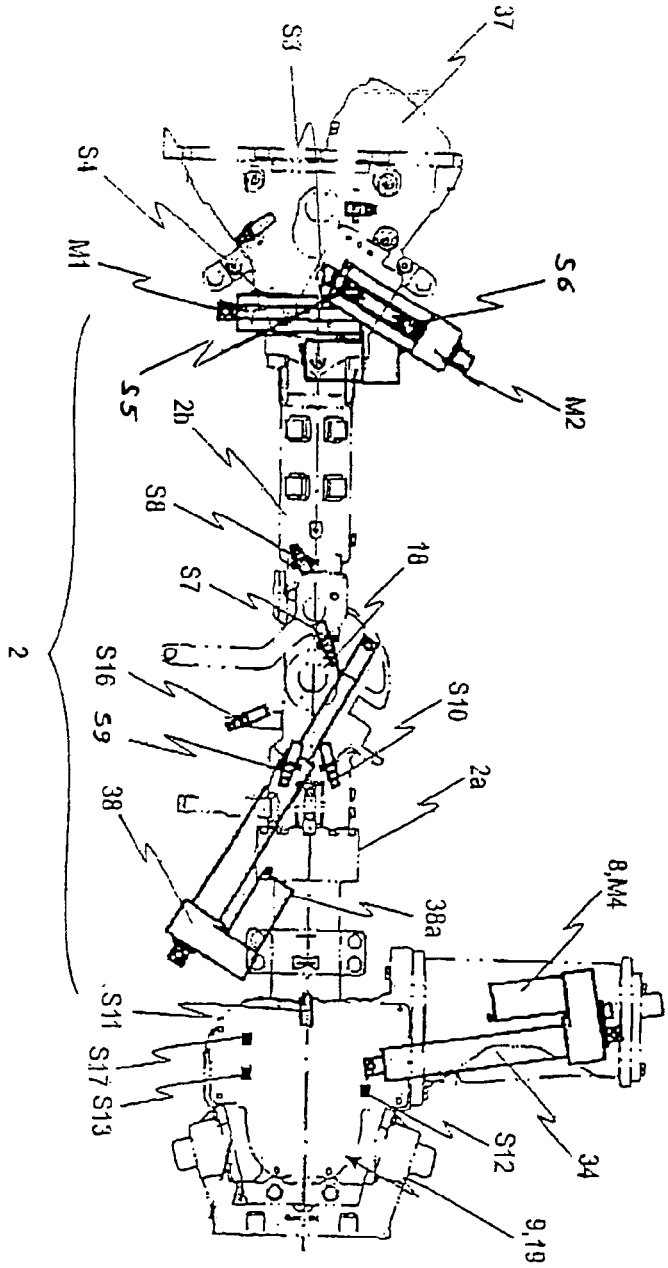
FIG. 6B (Top View)

CENTRAL BUFFER COUPLING

CROSS REFERENCE TO RELATED APPLICATIONS

Applicant claims priority under 35 U.S.C. § 119 of European Application No. 03 028 145.5 filed Dec. 5, 2003.

1. Field of the Invention

The present invention relates to a central buffer coupling for coupling a first rail car body with a second, adjacent rail car body of a multiple-unit rail vehicle. The coupling has a coupling head affixed to a linking housing of the rail car body so as to pivot, by means of a coupling shaft, and a pivoting unit for pivoting the coupling shaft. The pivoting unit has a guide that participates in a horizontal pivoting movement of the coupling shaft that runs about a vertical pivot axis. The pivoting unit also has an activation device for positioning the guide, together with the action-connected coupling shaft, in a desired position of the planned pivoting range. The pivoting unit furthermore has pressure surfaces assigned to a pressure device, in each instance, for bringing about horizontal re-centering of the coupling shaft. The pressure devices, in each instance, are supported on the linking housing of the coupling shaft, in order to bias the related pressure surfaces against the guide.

2. The Prior Art

Central buffer couplings of this type are generally known from the state of the art. Generally, in central buffer couplings that can pivot in, the coupling shaft is formed by a rear and a front shaft part. The shaft parts are connected with one another by means of a joint having a vertical pivot axis. In this way, the front shaft part can be horizontally pivoted relative to the rear shaft part. In this connection, the pivoting unit makes it possible to bring the front shaft part, to which the coupling head is attached, from an extended position in which it is ready for operation into a parked, pivoted-in position. In the extended position, the coupling head projects beyond the face wall of the vehicle. In the parked, pivoted-in position, the front shaft part with the coupling head is located behind the face wall of the vehicle.

A central buffer coupling having a device for horizontal re-centering is known, for example, from DE 24 19 184 A1, in which a pressure spring is disposed symmetrically on both sides of the coupling axis, which spring rests against a slide piece that is guided in the housing, in each instance. The slide pieces are each pressed against a guide that participates in the horizontal pivoting movement of the coupling shaft about the vertical pivot axis of the central buffer coupling, by way of a related support roller having a vertical axis, by means of the force of the biased pressure springs. The support rollers form a pair of support rollers, in each instance, that are mounted in the guide, symmetrically on both sides of the coupling axis; the two support rollers of each pair are at different distances from the coupling axis, in each instance.

In this connection, the axis of the support rollers lies on a circle that is concentric to the vertical pivot axis of the central buffer coupling. In the center position of the central buffer coupling, the support rollers of each pair of support rollers rest against the slide surface of the slide piece, in each instance, which piece has an approximately triangular shape in a top view, whereby a guide shaft is disposed on each slide piece, which shaft penetrates through the housing. In normal operation, i.e. also when traveling along curves or through switches, the pivoting unit is constantly in effect, so that a relatively great wear occurs, as a result of the pivoting movement of the central buffer coupling, at the slide surfaces of the slide pieces, which are pressed against the support rollers by the pressure spring. Coupling in a curve is possible only with difficulty, or not at all, since here, the re-set forces of the pressure spring counteract the manually effected pivoting-out of the central buffer couplings to be coupled.

It is true that the devices known from the state of the art are able to allow re-centering or fixation of the coupling shaft in the center position, and also a shut-off and thereby stress-relieved, manual pivoting of the coupling shaft, but this re-centering or pivoting continues to require the use of personnel for work in the coupling area, which work is highly hazardous. Automated or remote-controlled positioning of the coupling shaft and thereby of the coupling head, in accordance with requirements, in arcs, particularly in tight arcs, is not possible with the known central buffer couplings and is also not planned. Such known central buffer couplings are unable to achieve particularly precise positioning, in any angular position of a horizontal pivot range that is provided. The same also holds true for freely selectable positioning of the coupling shaft by way of the pressure springs.

Furthermore, a device for horizontal re-centering for a central buffer coupling affixed to a rail vehicle by means of a coupling shaft, so as to pivot, is known from DE 101 62 731 A1. That device has a guide that participates in the pivoting movement of the coupling shaft about its vertical pivot axis, as well as pressure surfaces provided symmetrical to the longitudinal axis of the coupling shaft, whereby a pressure device is assigned to each pressure surface, which are supported relative to a linking housing and bring about the horizontal re-centering of the coupling shaft. In this connection, it is provided that the pressure devices, in each instance, can be activated using a pneumatically, hydraulically, or electrically operated means of activation. In the case of this known device, the means of activation is configured as a remote-controlled setting drive. This drive can be used to position the guide, and thereby the coupling shaft that is connected to work with it, in any position of the planned horizontal pivoting range of the coupling shaft, with a force flow by way of the device for re-centering, in order, in particular, to facilitate coupling in tight arcs, or actually make it possible.

In the case of this known device, the force flow for pivoting the coupling shaft takes place from a worm-wheel drive to a worm-wheel gear mechanism, the worm-wheel of which is connected with the bearing pin and thereby transfers the pivoting movement directly. Since no de-coupling or interruption of the force flow between the activation device of the worm-wheel drive to the bearing pin is provided in the case of this principle known from the state of the art, every pivoting-out movement of the coupling shaft during traveling operation is directly transferred all the way to the activation device. However, since worm-wheel gear mechanisms are generally considered to be self-locking, pivoting-out during traveling operation, using the known device is possible, if at all, only with a great expenditure of force, since here, two worm-wheel gear mechanisms switched one behind the other are actually provided. Furthermore, pivoting-out during traveling operation causes very great wear in the worm-wheel gear mechanisms.

SUMMARY OF THE INVENTION

In view of the problems that occur with the known central buffer couplings, the object of the present invention is to provide a central buffer coupling having a device for horizontal re-centering according to DE 101 62 731 A1, in such a manner that decoupling of the force flow between the activation device and the bearing pin is made possible. In this way, the swing-out movements of the coupling shaft that occur during traveling operation are effectively prevented from being transferred directly all the way to the activation device.

According to one aspect of the present invention, this object is achieved by providing in a central buffer coupling of the type stated initially, a guide that is connected with the activation device by way of a pivoting device that can be brought into engagement with the guide, wherein the engagement can be released in the center position of the guide. The principle of the present invention makes use of the nonengagement of the pivoting device with the guide during traveling operation and therefore the pivoting device is also not in engagement with the coupling shaft that is connected to work with the guide. To put it differently, this arrangement results in the pivoting device no longer being affected by pivoting-out movements of the coupling shaft during traveling operation.

By means of the configuration according to the invention, namely that the guide can be connected with the activation device by way of the pivoting device, it is possible, in advantageous manner, to act directly on the guide by means of activating the activation device, thereby causing the guide to be rotated about a vertical pivot axis and forcing the coupling shaft into a horizontal pivoting movement. Because the engagement of the pivoting device with the guide, which is directly connected with the activation device, can be released in the center position of the coupling shaft, the result is achieved, in advantageous manner, that the force flow transferred by way of the coupling shaft and the bearing pins can no longer be transferred all the way to the activation device, so that thereby the wear of the gear mechanisms provided between the guide, i.e. the pivoting device, and the activation device, due to pivoting movements of the coupling shaft that occur during traveling operation, is clearly reduced. Possible means of activation in this connection are pneumatically, hydraulically, or electrically operated means of activation, such as hydraulic cylinders or linear drives in the form of electrical cylinders.

Furthermore, it is possible for example in the case of a defect of a lifting spindle drive of the activation device, that the pivoting device can be operated manually. By means of the solution according to the invention, it is now possible to pivot the coupling rod of the central buffer coupling in and out when moving the coupling head attached at the front end of the coupling shaft in and out. Therefore, not only is automated or remote-controlled precise positioning of the coupling rod and thereby of the coupling head possible in every angular position of a planned horizontal pivoting range, but also, in particular, freely selectable positioning of the coupling shaft by way of the pressure elements of the pivoting unit is possible, whereby the engagement of the pivoting unit with the guide can be released during traveling operation.

Advantageous further developments of the invention are discussed below.

Thus, in a particularly preferred embodiment of the central buffer coupling according to the invention, the guide is configured as a cam disk, which is mounted to rotate in the linking housing, about a vertically disposed pivot pin, and coupled to rotate synchronously with the coupling shaft. By configuring the guide as a rotating cam disk that rotates about the vertically disposed pivot pin, a particularly simple and easily implemented way of bringing about pivoting of the coupling shaft by means of the pivoting unit is achieved. In other words, by implementing a guide that participates in a horizontal pivoting movement of the coupling shaft about a vertical pivot axis, the coupling shaft is simply and easily pivoted. Of course, different embodiments are also possible here.

In a particularly preferred implementation of the central buffer coupling according to the invention, the pivoting device has a link configured with a contour, in the contour of which a guide pin is guided, which can be brought into engagement with a driver of the guide, which driver accommodates the guide pin. This further development represents a solution that can be implemented in particularly simple manner, and at the same time is very effective and, in particular, robust, with which solution the guide can be brought into engagement with the activation device and, vice versa, with which the engagement of the guide with the activation device can be released. For this purpose, it is provided, in preferred manner, that the link is rigidly connected with the linking housing of the coupling shaft or with the rail car body itself, and therefore cannot participate in any rotational movement with the guide, about the vertically disposed pivot pin.

In this embodiment, the contour of the pivoting device formed in the link serves as a guide for the guide pin, by way of which the engagement of the guide with the activation device is made possible. In advantageous manner, the contour of the pivoting device formed in the link has a particular shape, particularly an S-shaped swung shape or step-shaped shape, in which the guide pin is guided, and can be brought into engagement with the guide, as a function of the segment of the contour shape, in each instance. Because the link is rigidly connected with the linking housing or with the rail car body itself, each segment of the contour shape corresponds to a specific pivot range of the guide and therefore also of the coupling shaft that is connected to work with the guide, in preferred manner, so that it can be determined in advance, by way of the contour shape of the link, in which pivot region an engagement of the guide pin with the guide is supposed to take place or to be released.

In a particularly preferred further development of the last two embodiments discussed above, the guide, i.e. the cam disk, can be brought into engagement with a lever device that can be rotated about the pivot pin using the activation device. In this connection, this lever device is preferably mounted to rotate about the pivot pin, which also serves as an axle of rotation for the guide, i.e. the cam disk. In this connection, the activation device is directly connected with a working point on the lever device, by way of an adjuster or by way of a suitable transfer linkage. Because the engagement of the guide, i.e. the cam disk, with the lever device according to the invention and therefore with the activation device is releasable in the center position of the guide, de-coupling of the activation device with the guide is made possible, in particularly preferred manner. Of course, different embodiments are possible here, as well.

In another preferred further development of the last embodiment mentioned, the lever device furthermore has a guide slot in which the guide pin, which is guided in the contour, runs about the pivot pin during rotation of the lever device. Accordingly, the pivot pin is guided, on the one hand, by means of the guide slot that is provided in the lever device and runs, in preferred manner, almost radially to the pivot pin, and, on the other hand, by means of the contour that is formed in the link of the pivoting device.

This embodiment makes available a coupling location between the guide and the activation device that can be implemented in particularly simple manner, and, at the same time, is very effective, since it is made possible for the pivoting device not to be in engagement with the guide during traveling operation, and therefore also not to be affected by the pivoting-out movements of the coupling shaft transferred by the guide during traveling operation. By means of the activation device, for example a linear drive in the form of an electrical cylinder, the guide pin being guided by way of the contour is then pushed into the driver of the guide. The driver of the guide, in turn, is connected with the pivot pin of the guide, so that after the guide pin is pushed into the driver, the pivoting movement of the coupling shaft can take place by means of the activation device.

In a particularly preferred embodiment of the central buffer coupling according to the invention, the pivot pin is articulated on, aligning axially with regard to a vertically oriented bearing pin that connects the coupling shaft with the linking housing. In this way, a possibility that can be implemented in particularly simple manner is indicated, which can be used to transfer the rotational movement of the guide about the pivot pin, which is brought about by means of the activation device, to the coupling shaft. Of course, different embodiments are possible here, as well.

In a particularly preferred implementation of the last embodiment of the central buffer coupling according to the invention as mentioned above, the pivot pin is connected with the bearing pin so as to work directly with it.

In order to automatically shut off the activation device after an end position has been reached, i.e. after the planned end position in the pivoting range of the central buffer coupling has been reached, a particularly preferred embodiment provides a device in the region of a lateral end position of the coupling shaft, i.e. of the central buffer coupling. This device triggers shut-off of the activation device. Furthermore, it is possible that pivoting the coupling shaft back after the center position has been reached can also be performed with an automatic shut-off.

In another embodiment, the coupling shaft is formed by a rear and a front shaft part, which are connected by means of a joint having a vertical pivot axis, whereby the front shaft part is configured to pivot horizontally relative to the rear shaft part. In this embodiment of the coupling shaft, together with the embodiment of the pivoting unit according to the present invention, it is possible to implement pivoting the coupling shaft in and out while moving the central buffer coupling in and out. In this connection, this process takes place in interaction with the bend joint integrated into the coupling shaft between the front and rear shaft part.

In another further development of the last-mentioned embodiment, a device is disposed in the region of a lateral end position of the coupling shaft, i.e. of the central buffer coupling. This device initiates the pivoting process of the front shaft part. A lift spindle drive that is controlled by means of an approximation switch serves as such a device, for example.

In particularly preferred manner, the pivoting procedures of the pivoting of the extended coupling shaft, from the center position into a lateral end position and vice versa, and/or the pivoting procedures of the pivoting of the front shaft part, may be automated or remote-controlled. Depending on the requirements and the planned degree of automation, all of the pivoting procedures or parts of them can take place in automated or remote-controlled manner.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawing, wherein similar reference characters denote similar elements throughout the several views:

FIG. 6A is a schematic side view of the central buffer coupling according to the invention, to illustrate the position of the switches and motors;

FIG. 6B is a schematic top view of the central buffer coupling according to the invention, according to FIG. 6A.

DETAILED DESCRIPTION OF PREFERRED EMBODIMENTS

Figure 1:
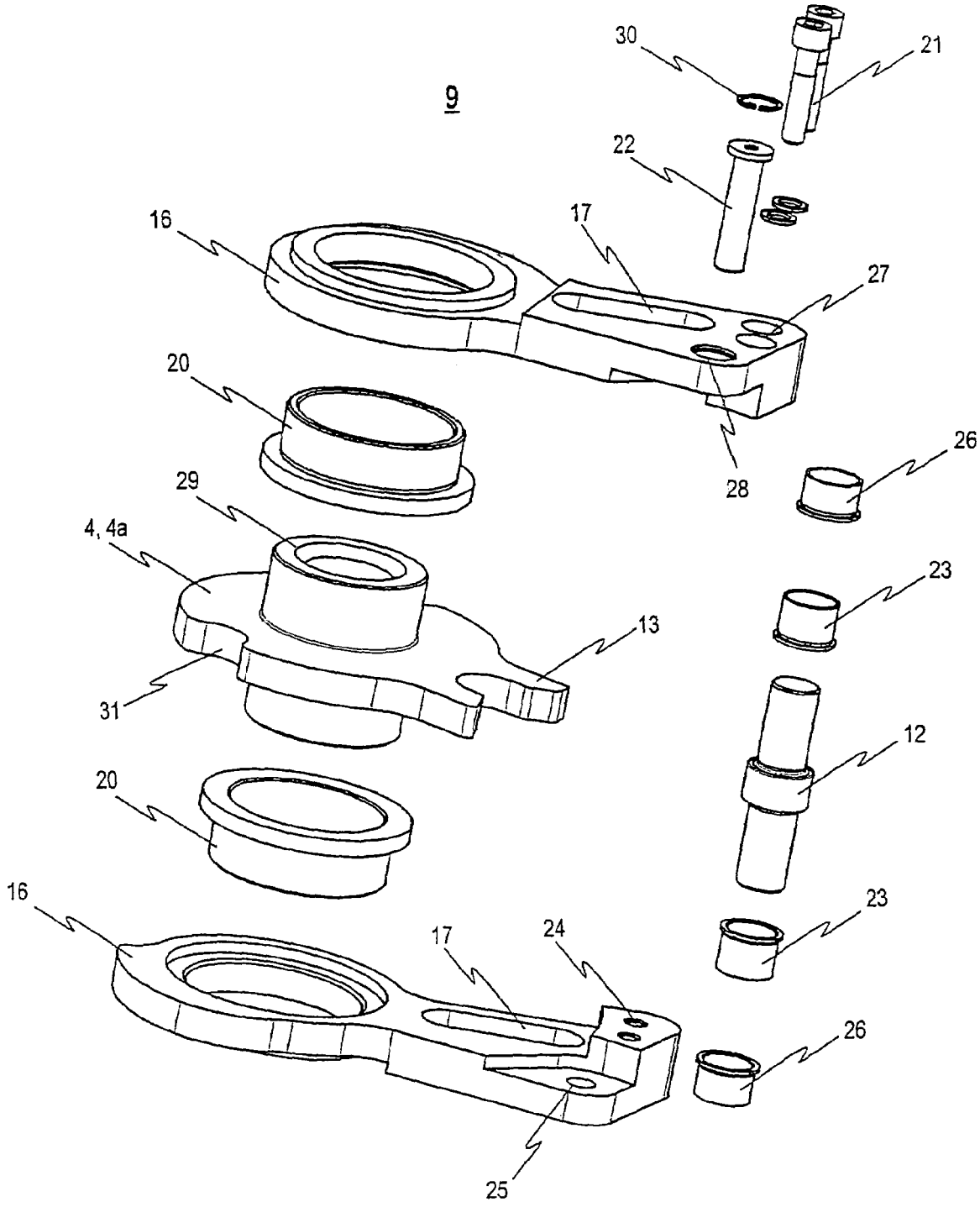
FIG. 1 is an exploded view of a preferred embodiment of the pivoting device according to the invention, without a link.

Turning now in detail to the drawings and in particular making reference to FIGS. 1 and 2, a preferred embodiment of the pivoting device according to the invention will first be explained. FIG. 1 shows an exploded view of a preferred embodiment of the pivoting device according to the invention, without a link. FIGS. 2A to 2C show the pivoting device according to the invention in the assembled state, without a link.

As shown, the pivoting device 9 is composed of an upper and a lower part of a lever device 16. Between the upper and the lower part of lever device 16, a guide 4 is provided, which is mounted to rotate with slide rings 20 in the assembled state. For this purpose, slide rings 20 are set over a pin accommodation 29 provided at the upper and the lower side of guide 4, in each instance. In the representation of the preferred embodiment shown in FIGS. 1 and 2A–2C, guide 4 takes the form of a cam disk 4*a* having recesses as pressure absorption regions 31. In the assembled and inserted state, pressure surfaces of the pivoting unit formed by pivoting device 9 engage in these pressure absorption regions 31 in the assembled and inserted state, in each instance; the pressure surfaces are not explicitly shown in FIGS. 1 and 2.

Furthermore, a driver 13 in the form of a symmetrically configured, mouth-shaped projection is formed on cam disk 4*a*, i.e. on guide 4. Furthermore, axially disposed pin accommodation 29 previously mentioned runs through guide 4, i.e. cam disk 4*a*; in the inserted state, a pivot pin, not explicitly shown, is set into it.

The upper and the lower part of lever device 16 has a section that projects out in lever-like manner, in each instance, in which a guide slot 17 that runs almost radially is provided. A guide pin 12 is set into this guide slot 17, so that it can move in the direction of slot 17. For this purpose, guide pin 12 is appropriately mounted by means of slide rings 23. In order to prevent guide pin 12 and slide rings 23 from falling out of guide slot 17 in the assembled state, guide heads 26 are provided, which are set onto the ends of guide pin 12 with slide rings 23 disposed in between, in each instance.

In the section of lever device 16 that extends in lever-like manner, passage holes 27 are provided in the upper part of lever device 16, into which fixation means 21 are inserted. Fixation means 21 are screwed into corresponding accommodations 24, for example threads, in the lower part of lever device 16, in order to thereby fix in place the upper part and the lower part of lever device 16 with guide 4 that is mounted to rotate between them. Furthermore, an adjustment pin 22 runs through a passage hole 28 of the upper part of lever device 16 and is fixed in place in the lower part of lever device 16, in an accommodation 25 provided for this purpose. A clamp ring 30 may be associated with adjustment pin 22. In the assembled state of the pivoting device, adjustment pin 22 serves as the working point for an adjuster, not specifically shown, which in turn works together, directly, with an activation device.

Figure 2A:
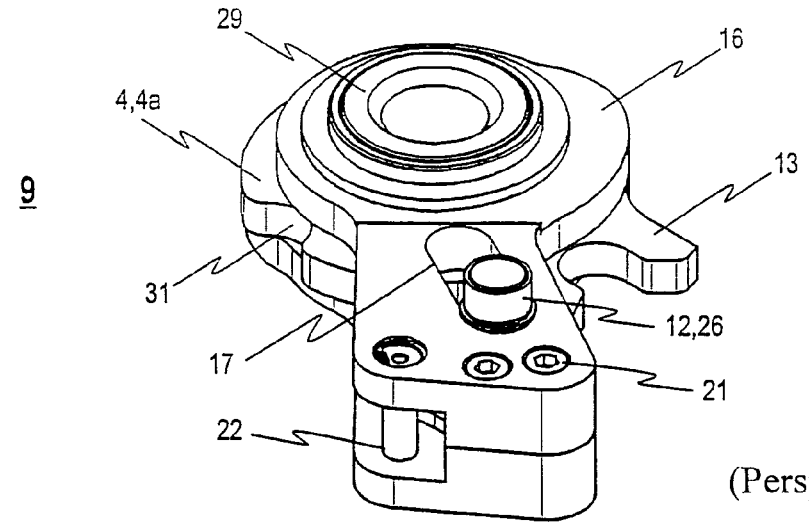
FIGS. 2A, 2B and 2C are perspective, side and top views, respectively, of the pivoting device according to FIG. 1, in the assembled state, without a link.
Figure 2B:
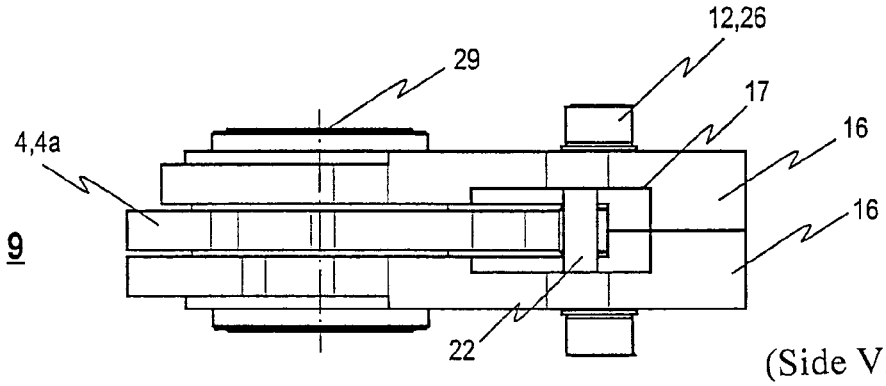
Figure 2C:
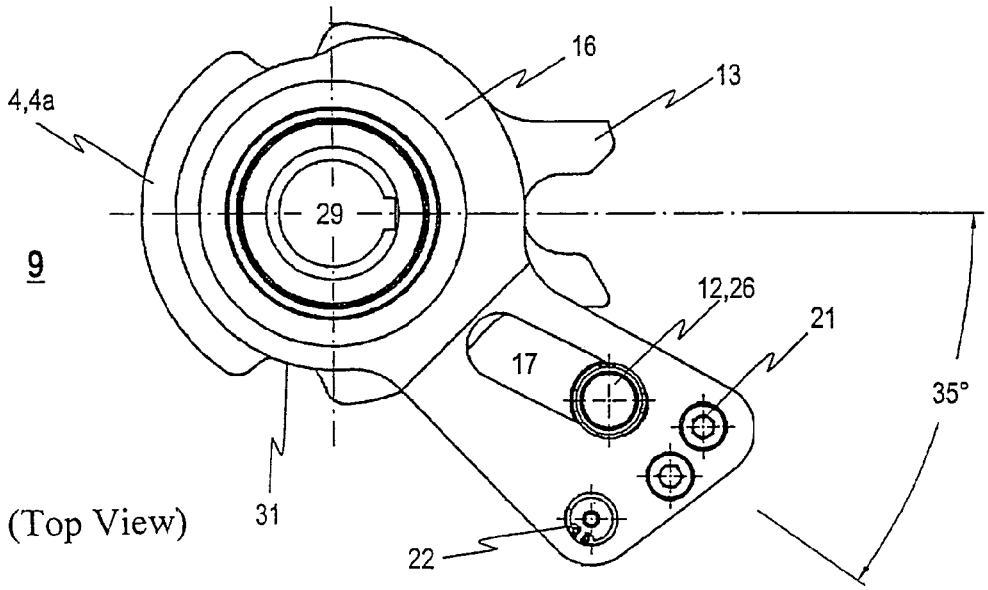

From the different representations of the pivoting device shown in FIGS. 2A to 2C, in the assembled state, it is evident that the design of lever device 16 and guide 4 with driver 13 provides a pivot range of about 35° for pivoting device 9. Of course, different pivot ranges are also possible here. It is further evident that the pressure absorption regions 31 provided in cam disk 4*a*, i.e. guide 4, are also positioned in accordance with the arrangement of the pressure surfaces (not shown).

Figure 3A:
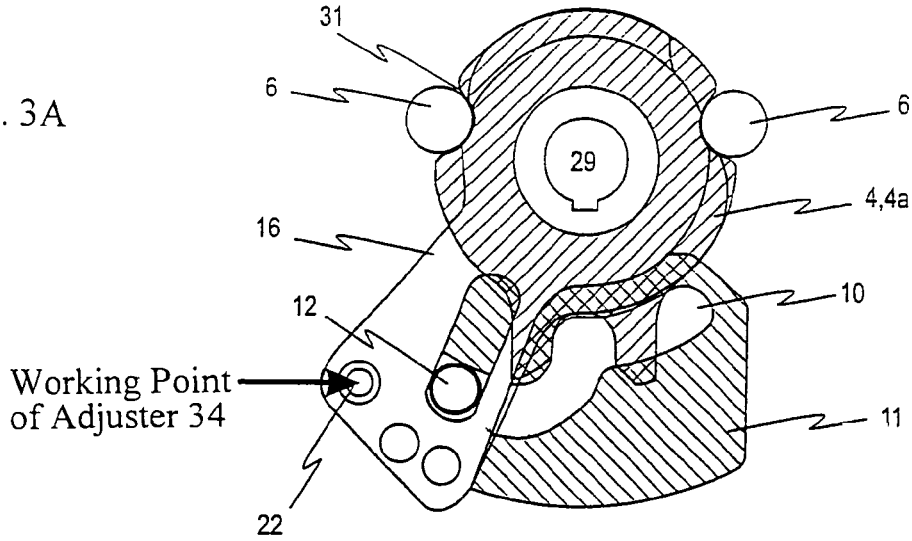
FIG. 3A is a functional sequence of a preferred embodiment of the pivoting device according to the invention, with a link, whereby the pivoting device is out of engagement and the center point of the coupling is in engagement.
Figure 3B:
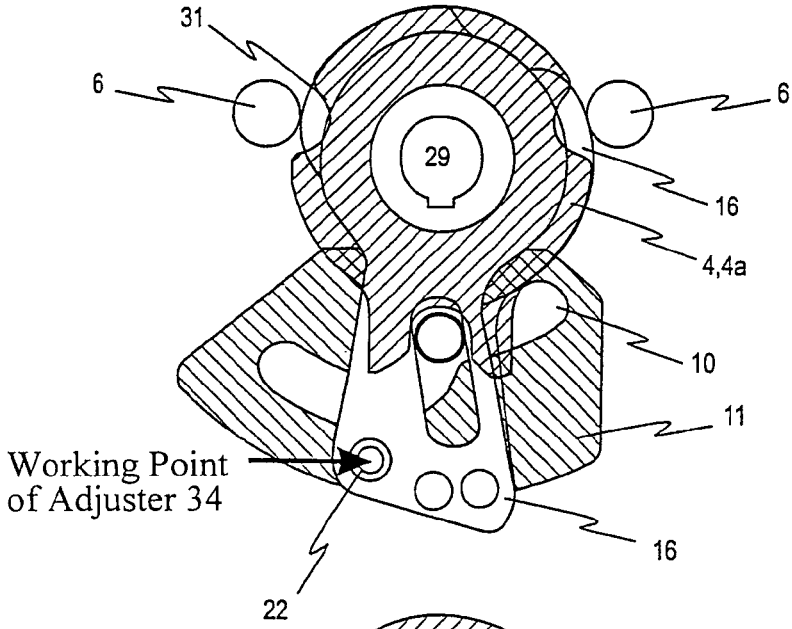
FIG. 3B is a functional sequence of a preferred embodiment of the pivoting device according to FIG. 3A, whereby the pivoting device is in engagement and the center position of the coupling is out of engagement.
Figure 3C:
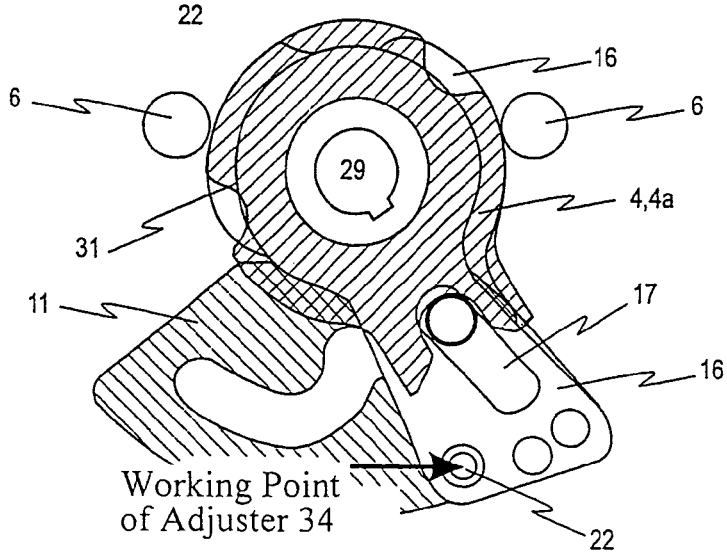
FIG. 3C is a functional sequence of a preferred embodiment of the pivoting device according to FIGS. 3A and 3B, whereby the center position of the coupling is out of engagement and the coupling is pivoted.

FIGS. 3A to 3C show a functional sequence of pivoting device 9 according to the invention, with a link 11. In detail, FIG. 3A shows a position in which pivoting device 9 is out of engagement and the center point of the central buffer coupling 3, i.e. of the coupling shaft, is in engagement. As shown, the pressure surfaces 6 are in engagement with the pressure recesses 31 of cam disk 4*a*, so that a center position 33 of the central buffer coupling, i.e. of the coupling shaft is present. In contrast to pivoting device 9 shown in FIGS. 1 and 2, a link 11 having a correspondingly configured contour 10 is now furthermore provided. In this arrangement, link 11 is attached to the linking housing of the coupling, i.e. to the rail car body frame, in the assembled state.

FIG. 3B shows a position, after only the lever device 16 was displaced by approximately 15°, proceeding from the state shown in FIG. 3A, by way of an adjuster that is not explicitly shown and engages on the adjustment pin 22. During this movement, guide pin 12 is pushed into a position in which it is in engagement with driver 13 of guide 4, in interaction with guide slot 17 provided in lever device 16 and contour 10 of link 11. It should be pointed out that pressure surfaces 6 are pressed out of pressure absorption regions 31 of cam disk 4, in each instance, by means of the rotation of lever device 16 that is de-coupled from guide 4, by means of a corresponding contour 32 provided at the circumference side of lever device 16, counter to a bias force of the pressure device, not shown. In this way, the center position of the central buffer coupling, i.e. of the coupling shaft, is out of engagement, and pivoting device 9 is in engagement with driver 13 of guide 4.

FIG. 3C shows a state in which the lever-like segment of lever device 16 was further displaced by means of the adjuster that is not explicitly shown and engages on adjustment pin 22. Guide pin 12 continues to be in engagement with driver 13 of guide 4. Therefore, because of the shape of contour 10 provided in link 11, this time, in contrast to the movement sequences shown in FIGS. 3A and 3B, guide 4, together with the pivot pin 14 that passes through guide 4, is also rotated when the lever device 16 rotates. As before, pressure surfaces 6 are out of engagement with pressure absorption regions 31 of cam disk 4*a*, because of the contour of lever device 16, i.e. guide 4. Thus, in FIG. 3C, a situation is shown in which the center position of the coupling, i.e. of the coupling shaft, is out of engagement, and the coupling, i.e. the coupling shaft, was pivoted out of its center position by about 30°.

It should be pointed out that because of the shape of guide slot 17 in lever device 16, in interaction with contour 10 formed in link 11, different functional sequences of the center position of the central buffer coupling and of pivoting device 9 can also be achieved.

Figure 4:
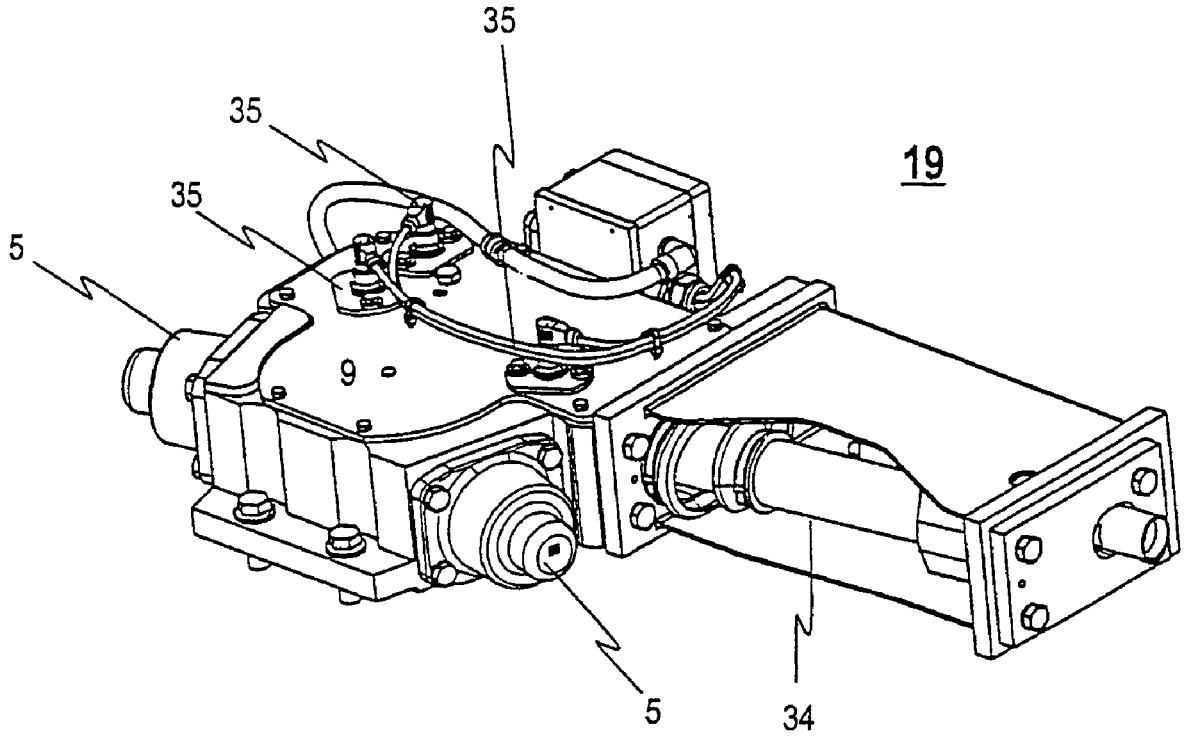
FIG. 4 is a perspective view of a preferred embodiment of the pivoting unit, in the assembled state.

FIG. 4 shows a perspective view of an embodiment of pivoting unit 19, into which pivoting device 9 as explained above is integrated. Pivoting unit 19 shown in this embodiment contains a pivoting device 9 that serves as a mechanical centering device. Pivoting device 9 is disposed above an elastomer spring joint, not shown, of a central buffer coupling, and is connected with it in shape-flow manner. FIG. 4 shows the entire module serving as pivoting unit 19, made up of pivoting device 9 serving as the centering device, the pressure devices 5, the approximation switch 35, which permit automatic operation and/or monitoring of pivoting unit 19, as well as an adjuster 34 that can be a lift-spindle drive, for example. Adjuster 34 is connected with an activation device such as an electric motor, not explicitly shown, by way of corresponding gear mechanisms, if necessary. In case of a defect of adjuster 34, pivoting unit 19 can also be activated manually, in preferred manner. For this purpose, a hand crank is inserted into the hexagon socket at the end of the lift-spindle drive, i.e. of the adjuster, shown in FIG. 4, and turned accordingly.

Figure 5:
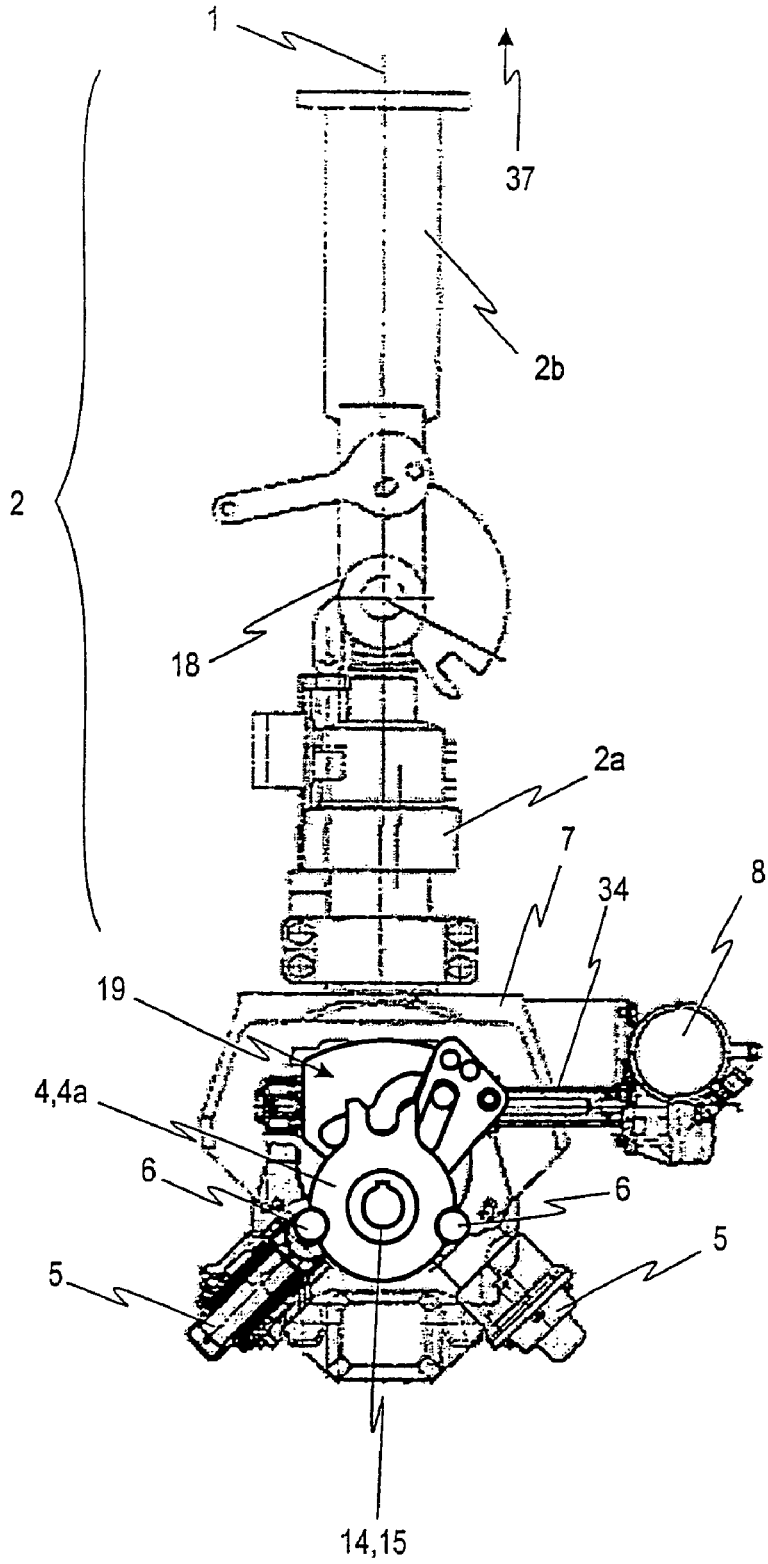
FIG. 5 is a top view of an embodiment of the installed pivoting unit, in a representation in partial cross-section.

FIG. 5 shows a top view of an embodiment of the installed pivoting unit 19, in a representation in partial cross-section. The central buffer coupling according to the invention has a coupling head 37, not explicitly shown, that is attached to pivot on a linking housing 7 of the rail car body, by means of a coupling shaft 2 and a pivoting unit 19. Pivoting unit 19 contains a guide 4 that participates in the pivoting movement of coupling shaft 2 about its vertical pivot axis. Guide 4 has pressure surfaces 6 disposed symmetrical to the longitudinal axis 1 of coupling shaft 2. Coupling shaft 2 is articulated in linking housing 7 by means of a vertically oriented bearing pin 15, and connected with the rail vehicle by means of the housing. In the partial cross-section shown in FIG. 5, the bearing pin 15 is disposed to align axially with the pivot pin 14 of pivoting unit 19, and connected to work with it. Furthermore, pressure devices 5 are disposed in linking housing 7. These devices bring about the horizontal re-centering, in interaction with pressure surfaces 6. In this connection, a pressure device 5 is assigned to every pressure surface 6. In the exemplary embodiment, guide 4 is configured as a cam disk 4*a* in accordance with FIGS. 1 to 3, which is mounted to rotate in linking housing 7 by means of vertically disposed pivot pins 14.

Cam disk 4*a* is coupled with coupling shaft 2 with rotation synchronicity, and pivot pin 14, as was already mentioned, is disposed to align axially with bearing pin 15 of coupling shaft 2. Pivot pin 14 is connected to work with bearing pin 15, and cam disk 4*a* is mounted to rotate in the pivoting device, in accordance with the representation in FIGS. 1 to 3.

Pressure device 5 is configured to act permanently, in the embodiment shown, or so that it turns off or can be turned off as a function of the pivot angle, or can be activated by means of a pneumatically, hydraulically, or electrically operated means of activation. The activation means or device 8 is configured as a remote-controlled setting drive in the exemplary embodiment. In this way, guide 4, i.e. cam disk 4*a*, can be positioned for re-centering in any position of the planned horizontal pivoting range of coupling shaft 2, with force flow byway of pivoting unit 19, using the setting drive by way of an adjuster 34.

In the region of a lateral end position of coupling shaft 2, a device, not shown, can be affixed, which automatically shuts activation device 8 off after the lateral end position has been reached. Furthermore, pivoting coupling shaft 2 back after the center position has been reached can be performed with automatic shut-off.

In the embodiment shown, coupling shaft 2 is formed by a rear shaft part 2*a* and a front shaft part 2*b*, which are connected with one another by means of a joint 18 having a vertical pivot axis, and front shaft part 2*b* is configured to pivot horizontally relative to rear shaft part 2*a*.

In the situation shown in FIG. 5, a coupled state of the central buffer coupling exists, in which the pivoting device is out of engagement, in order not to impair the function of the center position during traveling operation. Pivoting unit 19 therefore serves to pivot coupling rod 2 in and out as the coupling is moved in and out. This process takes place in interaction with bend joint 18 integrated into coupling rod 2.

FIGS. 6A and 6B show a schematic side view and top view, respectively, of the central buffer coupling, to illustrate the position of the switches and motors, including motor M1 which moves the coupling head 37, motor M2 for de-coupling, motor M3 which bends/extends coupling shaft 2, and motor M4 which pivots coupling head 37. As shown schematically, a second pivoting unit 38, M3 is disposed in the region of the lateral end position of coupling shaft 2, which unit initiates the pivoting procedure of front shaft part 2*b*, in automated manner, by way of a second setting drive 38*a*. Depending on the requirements and the planned degree of automation, all the pivoting procedures, or parts of them, can be automated or remote-controlled. In other words, the pivoting of the extended coupling shaft 2 from the center position into a lateral end position of the pivot range and vice versa, and/or the pivoting of the front shaft part 2*b* can be automated or remote-controlled.

In the following, an automated operation of a preferred embodiment of the central buffer coupling will be explained, using FIGS. 6A and 6B: In the coupled state of the central buffer coupling, as shown, pivoting device 9 of pivoting unit 19 is out of engagement and therefore is present in the position shown in FIG. 3A, in order not to impair the function of the center position during traveling operation. This position of pivoting device 9 is monitored by means of an approximation switch S12. If the coupling is supposed to be carried back under the image apron (not shown) after de-coupling, which is indicated by a signal from the vehicle control, activation device 8, which is indicated as a lift-spindle drive M4 in FIGS. 6A and B, and is located in pivoting unit 19, moves the center position and therefore the elastomer spring joint and the entire coupling, until an approximation switch S17 is touched at an intermediate position of pivoting device 9 after an angle of rotation of approximately 20°.

As soon as this switch has been touched, the lift-spindle drive M4 stops, in order to allow coupling rod 2 to bend in, in interaction with bend joint 18. After coupling rod 2 has then reached its intermediate position, i.e. when an approximation switch S16 has been touched, lift-spindle drive M4 of pivoting unit 19 starts again, and turns the center position further to its "park position", which is recognized by an approximation switch S13. When this end position has been reached, lift-spindle drive M4 is shut off. A mechanical lock in the interior of the center position guarantees that the coupling will be reliably held in the pivoted position. Moving the coupling out ahead of the coupling procedure that is initiated by a signal from the vehicle control, takes place analogous to the moving-in procedure described above. An approximation switch S11 is touched as soon as the pivoting device 19 has moved the coupling shaft 2 back into its center position. A switch S10 may also be provided, which serves to detect when the coupling shaft 2 is bent.

Furthermore, the switches S1 (position heart piece), S2 (query counter-coupling eye), S3 (E-coupling rear), S4 (E-coupling front), S7 (bend joint locked) and S8 (bend joint unlocked) are also provided, which serve to detect the coupling status and the status of the shaft parts 2*a* and *b*. The motors M1 and M2 serve to move the coupling head 37 and for de-coupling. The reference symbol Y1 designates a lift magnet for unlocking the bend joint 36.

In summary, the invention provides de-coupling, i.e. interruption of the force flow between bearing pins 15 and activation device 8, by means of pivoting unit 19, in order to thereby prevent a transfer of any pivoting-out movement of coupling shaft 2 to activation device 8 during traveling operation. The principle, according to the invention, of pivoting unit 19 is based on the pivoting device 9 not being in engagement during traveling operation. To put it differently, this nonengagement means that pivoting unit 19 is not affected by pivoting-out movements of coupling shaft 2 during traveling operation. By means of a linear drive in the form of adjuster 34 driven by way of activation device 8, the guide pin 12 guided by way of contour 10 of link 11 is pushed into driver 13, towards guide 4. Because driver 13 is connected with bearing pin 15, the pivoting movement of coupling shaft 2 takes place by means of activation device 8, i.e. adjuster 34 driven by the activation device, after guide pin 12 has been pushed into driver 13.

Although only a few embodiments of the present invention have been shown and described, it is to be understood that many changes and modifications may be made thereunto without departing from the spirit and scope of the invention as defined in the appended claims.

What is claimed is:

1. A central buffer coupling for coupling a first rail car body with a second, adjacent rail car body of a multiple-unit rail vehicle comprising:

a) a linking housing in a rail car body comprising a plurality of pressure devices;

b) an action linked coupling shaft having a longitudinal axis;

c) a coupling head pivotally connected by the coupling shaft to the linking housing of the rail car body;

d) a pivoting unit for pivoting the coupling shaft comprising a guide, an activation device for positioning the guide and the action linked coupling shaft in any selected position of a planned pivoting range, and a plurality of pressure surfaces symmetric to said longitudinal axis of the coupling shaft, said guide participating in a horizontal pivoting movement of the coupling shaft that runs about a vertical pivot axis, each pressure surface of said plurality of pressure surfaces corresponding to a respective one of said plurality of pressure devices for bringing about horizontal re-centering of the coupling shaft, each pressure device being supported on the linking housing of the coupling shaft in order to bias the corresponding pressure surface against the guide; and e) a pivoting device connecting the guide with the activation device, said pivoting device being engageable with the guide and releasable in a center position of the guide;

wherein said pivoting device has a link comprising a contour, said central buffer coupling further comprises a guide pin guided in the contour, said guide comprises a driver accommodating the guide pin, and said guide pin is engageable with the driver.

2. The central buffer coupling as recited in claim 1, wherein the guide comprises a cam disk mounted to rotate in the linking housing, about a vertically disposed pivot pin, and coupled to rotate synchronously with the coupling shaft.

3. The central buffer coupling as recited in claim 2, further comprising a lever device engageable with the cam disk, said lever device being rotatable about the pivot pin using the activation device.

4. The central buffer coupling as recited in claim 3, wherein the lever device has a guide slot, the guide pin running in the guide slot about the pivot pin during rotation of the lever device.

5. The central buffer coupling as recited in claim 2, further comprising a vertically oriented bearing pin connecting the coupling shaft with the linking housing, the pivot pin being articulated on and aligning axially with regard to the vertically oriented bearing pin.

6. The central buffer coupling as recited in claim 5, wherein the pivot pin is connected with the bearing pin action-linked with the bearing pin.

7. The central buffer coupling as recited in claim 1, further comprising a device near a lateral end position of the coupling shaft, said device automatically shutting off the activation device after the end position has been reached.

8. The central buffer coupling as recited in claim 1, wherein the coupling shaft comprises a rear shaft part and a front shaft part, said shaft parts being connected by a joint having a vertical pivot axis, said front shaft part being pivotable horizontally relative to the rear shaft part.

9. The central buffer coupling as recited in claim 8, further comprising a device disposed near a lateral end position of the coupling shaft, said device initiating pivoting of the front shaft part.

10. The central buffer coupling as recited in claim 1, wherein the coupling shaft in an extended position is automatically or by remote control pivotable from a center position into a lateral end position and vice versa.

11. The central buffer coupling as recited in claim 8, wherein the front shaft part is pivotable automatically or by remote control.

* * * * *